US009231294B2

(12) United States Patent
Lu et al.

(10) Patent No.: US 9,231,294 B2
(45) Date of Patent: Jan. 5, 2016

(54) METHOD AND APPARATUS FOR COMPENSATING FREQUENCY SHIFTING OF ANTENNA

(71) Applicant: LENOVO (BEIJING) CO., LTD., Beijing (CN)

(72) Inventors: Kai Lu, Beijing (CN); Zhaowei Hu, Beijing (CN); Dafei Mo, Beijing (CN); Chunmei Ye, Beijing (CN)

(73) Assignee: LENOVO (BEIJING) CO., LTD., Beijing (CN)

( * ) Notice: Subject to any disclaimer, the term of this patent is extended or adjusted under 35 U.S.C. 154(b) by 0 days.

(21) Appl. No.: 13/845,794

(22) Filed: Mar. 18, 2013

(65) Prior Publication Data

US 2013/0252662 A1 Sep. 26, 2013

(30) Foreign Application Priority Data

Mar. 23, 2012 (CN) ..... 2012 1 0081014

(51) Int. Cl.
*H01Q 1/24* (2006.01)
*H01Q 1/22* (2006.01)

(52) U.S. Cl.
CPC ..... *H01Q 1/245* (2013.01); *H01Q 1/2266* (2013.01)

(58) Field of Classification Search
USPC ..... 455/552.1; 333/32
See application file for complete search history.

(56) References Cited

U.S. PATENT DOCUMENTS

2013/0069737 A1* 3/2013 See et al. ..... 333/32

FOREIGN PATENT DOCUMENTS

CN 101154961 A 4/2008
CN 102170305 A 8/2011

OTHER PUBLICATIONS

Chinese Patent Application No. 201210081014.1, Chinese Patent Office, First Office Action mailed on Jan. 6, 2015; 9 pages.
English Text of Chinese Patent Application No. 201210081014.1, Chinese Patent Office, First Office Action mailed on Jan. 6, 2015; 10 pages.
Chinese Patent Application No. 201210081014.1, Chinese Patent Office, Second Office Action mailed Aug. 25, 2015; 8 pages.
English Text of Second Office Action for Chinese Patent Application No. 201210081014.1, Chinese Patent Office, Second Office Action mailed Aug. 25, 2015; 10 pages.

* cited by examiner

*Primary Examiner* — Junpeng Chen
(74) *Attorney, Agent, or Firm* — Dentons US LLP

(57) ABSTRACT

The present invention provides a method and an apparatus for compensating frequency shifting of an antenna, applicable to a wireless communication device having at least one frequency shifted operating mode, in which a frequency shifting exists due to a variation of a device use mode or an environmental condition, wherein the method comprises setting in the antenna at least one compensation matching circuit corresponding to the at least one frequency shifted operating mode; detecting the use mode, in which the wireless communication device operates; when the wireless communication device is in the frequency shifted operating mode, switching to a compensation matching circuit corresponding to the frequency shifted operating mode as detected. In the present invention, the difficulty in the bandwidth design of the antenna is reduced, and the effect of the variation of the use mode or environmental condition on the performance of the antenna is compensated adaptively.

8 Claims, 3 Drawing Sheets

METHOD AND APPARATUS FOR COMPENSATING FREQUENCY SHIFTING OF ANTENNA

This application claims the benefit under 35 U.S.C. §119 (a) of Chinese Patent Application No. 201210081014.1, filed on Mar. 23, 2012, the entire disclosure of which is incorporated herein by references for all purposes.

TECHNICAL FIELD

The present invention relates to a technical field of communication and particularly, to a method and an apparatus for compensating a frequency shifting of an antenna.

BACKGROUND

With development of the communication technique, various types of wireless communication devices such as computers, personal digital assistants, mobile phones, and the like emerge. The wireless communication devices have a function of wireless communication and thus, facilitate transmission of information and data greatly.

A wireless communication device has an antenna to implement the function of wireless communication. In general, the antenna is designed for a typical use mode of the wireless communication device. When the wireless communication device operates in the typical use mode, the antenna has a good working performance, so that the wireless communication device can communicate efficiently.

Nevertheless, it is necessary for the current wireless communication devices to operate in a variety of environments, and the functions of the wireless communication device have been enhanced gradually to possess different use modes. When the wireless communication device changes the use mode thereof and is not within the typical use mode, the working band of the antenna designed for the typical use mode shifts, thus causing the deterioration of the performance of the antenna. Hence, a traditional antenna is not suitable for all of the use states; the performance of the antenna may deteriorate, and the antenna might even malfunction. In addition, when the environment, where the wireless communication device is located, varies, for example, when the wireless communication device is close to the human body or close to an electromagnetic environment, the working band of the antenna can also shift. Therefore, the traditional antenna cannot deal with the effects that result from the variation of the use mode or the environmental condition.

When the working band of the antenna shifts, generally, the working band thereof is broadened to compensate the effect of the frequency shifting due to the variation of the use mode or the environmental condition. However, a great deal of human power and time to adjust the shifted working band is needed, and as the limitations of various techniques, it is difficult to increase the working band of the wireless communication device. Therefore, there are disadvantages to addressing the issue of the frequency shifting by increasing the working band of the antenna, such as high cost, poor effect, and the like. In addition, under a certain environmental condition, for example, in the case that a human body is close to the antenna, the performance of the antenna is often deteriorated artificially to satisfy SAR (Specific Absorption Rate) standard of the electromagnetic radiation to comply with the requirements of a certification test. Hence, the traditional antenna cannot meet the requirements of both the high radiation efficiency and that of the SAR standard.

SUMMARY

Embodiments of the present invention provide a method and an apparatus for compensating frequency shifting of an antenna, which can reduce the difficulty in the bandwidth design of an antenna in a wireless communication device and can adaptively compensate an effect on performance of the antenna due to a variation of a use mode or an environmental condition.

On the one hand, a method for compensating a frequency shifting of an antenna is provided. Applicable to a wireless communication device with the antenna, a wireless communication device having at least one frequency shifted operating mode, in which a frequency shifting exists due to a variation of a use mode of the wireless communication device or an environmental condition. The method comprises the steps of setting in the antenna in at least one compensation matching circuit corresponding to at least one frequency shifted operating mode. Detecting a use mode, in which the wireless communication device operates to obtain a detecting result. When the detecting result indicates that the wireless communication device is in the frequency shifted operating mode, switching to a compensation matching circuit corresponding to the detected frequency shifted operating mode to compensate the frequency shifting of the antenna.

Preferably, the frequency shifted operating mode comprises a certification test mode, in which a human body is close to the antenna. In the case where the detecting result indicates that the frequency shifted operating mode is the certification test mode, a sensing capacitor is formed between the human body and the antenna. This switches to the compensation matching circuit corresponding to the certification test mode, and the compensation matching circuit corresponding to the certification test mode cooperates with the sensing capacitor to compensate the frequency shifting in the certification test mode.

In the certification test mode, the compensation matching circuit is formed by both the compensation matching circuit corresponding to the certification test mode and the sensing capacitor between the human body and the antenna together. The antenna enters into a state of partial mismatching, thus a radiation power on the human body is reduced, the certification test standard is satisfied, and the radiation efficiency of the antenna is ensured.

Preferably, the frequency shifted operating mode comprises a specific use mode of the wireless communication device. By preference, the wireless communication device is a notebook computer, and the specific use mode is at least one of a camping mode, a standing mode, and a flat panel mode of the notebook computer.

For the specific use mode of the wireless communication device, the compensation matching circuit adaptive to the specific use mode is employed, and it ensures that the wireless communication device has a good antenna performance in various use modes. Thus, it eliminates or alleviates the deterioration of the antenna performance due to the variation of the use mode or the environmental condition.

The compensation matching circuit includes a double-throw switch, and the step for switching to the compensation matching circuit corresponding to the detecting result includes changing the operating state of the double-throw switch.

On the other hand, an apparatus for compensating a frequency shifting of an antenna is provided, the apparatus being used in a wireless communication device having the antenna, wherein the wireless communication device has at least one frequency shifted operating mode, in which a frequency shifting exists due to a variation of a use mode of the wireless communication device or an environmental condition. The apparatus comprises at least one compensation matching circuit for compensating the frequency shifting in correspondence with at least one frequency shifted operating mode; a detecting unit for detecting use mode, in which the wireless communication device operates to obtain a detecting result; and a switching unit for switching to a compensation matching circuit corresponding to the detected frequency shifted operating mode to compensate the frequency shifting of the antenna when the detecting result indicates that the wireless communication device is in the frequency shifted operating mode.

In the above technical solutions for compensating the frequency shifting of the antenna, according to the embodiments of the present invention, by setting the compensation matching circuit corresponding to the different use modes or environmental conditions, the difficulty in the bandwidth design of the antenna of the wireless communication device is reduced, and the effect of the variation of the use mode or environmental condition on the performance of the antenna is compensated adaptively.

BRIEF DESCRIPTION OF THE DRAWINGS

In order to illustrate the technical solutions of the embodiments of the present invention more clearly, hereinafter a simplified introduction will be given to the accompanying drawings to be used in the descriptions of the embodiments or the prior art. Obviously, the accompanying drawings in the following descriptions only show some of the embodiments of the present invention, and for those skilled in the art, it is easy to obtain other accompanying drawings from the drawings explained as below.

DETAILED DESCRIPTION OF THE PREFERRED EMBODIMENTS

A detailed and complete description will be given to the technical solutions of the embodiments of the present invention in combination with the accompanying drawings in the embodiments thereof. Obviously, the embodiments as described are a part of the embodiments of the present invention, rather than all of the embodiments of the present invention.

Figure 1:
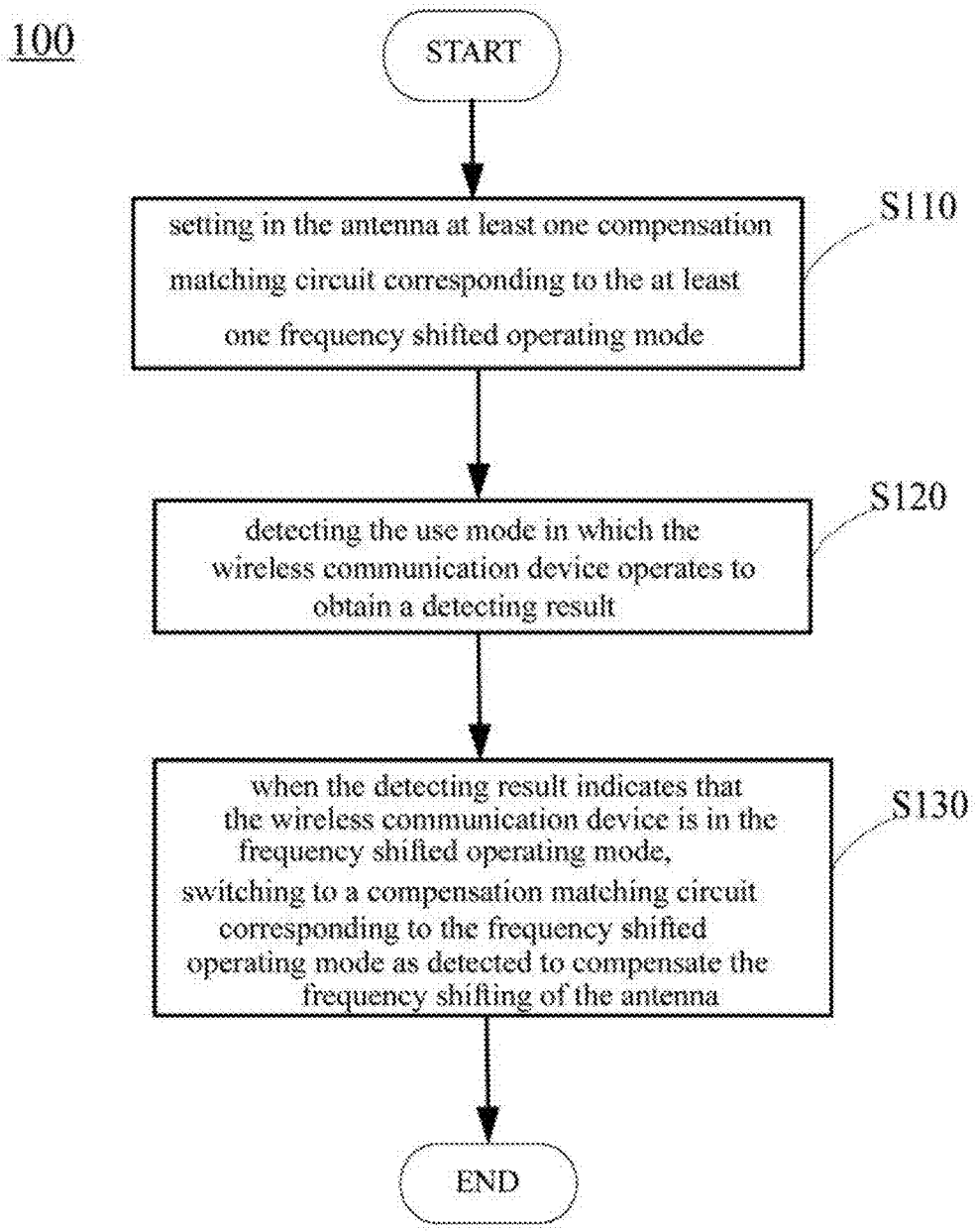
FIG. 1 illustrates a flow chart of a method for compensating a frequency shifting of an antenna according to an exemplified embodiment of the present invention.

FIG. 1 illustrates a flow chart of a method 100 for compensating the frequency shifting of an antenna, according to an exemplified embodiment of the present invention. The method 100 for compensating the frequency shifting of an antenna is applicable to a wireless communication device with an antenna, such as a computer, personal digital assistant, mobile phone, and the like. The method 100 for compensating the frequency shifting of the antenna can be used in any of the wireless communication devices having a wireless communication function. The wireless communication device has at least one frequency shifted operating mode, in which a frequency shifting exists due to a variation of the use mode of the wireless communication device or an environmental condition.

It is possible to define a plurality of frequency shifted operating modes for the different use modes or the environmental conditions, in which the wireless communication device operates. Hereinafter, taking a notebook computer as an example for illustration, the notebook computer can include a first body having a display, a second body having a keyboard, and an angle $\alpha$ between the first body, and the second body that can vary in a range of 0 to 360 degrees. The notebook computer typically operates in a use mode, in which the angle $\alpha$ is about 110 degrees (i.e., a normal use mode). If the angle is within the range of 0 to 180 degrees, but it deviates from 110 degrees (for example, changing to around 85 degrees or around 125 degrees), a working band of the antenna of the notebook computer shifts. In addition, the notebook can also have a certification test mode, in which a human body is close to the notebook computer, and some specific use modes that can comprise, for instance, a flat panel mode, in which the angle $\alpha$ is about 360 degrees, a camping mode in which the angle $\alpha$ is in the range of 180 to 360 degrees and the angle is on upside, and a standing mode in which the angle $\alpha$ is in the range of 180 to 360 degrees and the keyboard faces downwards. In the above use modes, the working band of the antenna of the notebook computer can also shift. Beside the normal use mode, it is possible to define different frequency shifted operating modes corresponding to the use modes one-to-one. In addition, according to the characteristics of the frequency shifting in the different use modes or environmental conditions, it is possible to integrate the above use modes appropriately. For example, the frequency shifted operating modes of the notebook computer can include a deviation use mode, in which the angle is around 85 degrees or 125 degrees, and an exhibition use mode comprising the camping mode, the standing mode, a flat panel mode, and a certification test mode.

In addition, for other type of wireless communication device, for example, for a mobile communication terminal, one or more frequency shifted operating modes can be defined for the mobile communication terminal based on the cases in which the antenna of the mobile communication terminal shifts over frequency in different use modes or environmental conditions.

The method 100 for compensating the frequency shifting of the antenna can comprise the steps of setting the antenna in at least one compensation matching circuit corresponding to at least one frequency shifted operating mode (step S110); detecting the use mode, in which the wireless communication device operates to obtain a detecting result (step S120); when the detecting result indicates that the wireless communication device is in the frequency shifted operating mode, it switches to a compensation matching circuit corresponding to the frequency shifted operating mode as detected to compensate the frequency shifting of the antenna (step S130).

At step S110, at least one compensation matching circuit is set in the antenna to correspond to at least one frequency shifted operating mode. One or more compensation matching circuits are set for the different frequency shifted operating modes of the wireless communication device.

The frequency shifted operating modes can include specific use modes of the wireless communication device. Taking a notebook computer as an example of a wireless communication device, the specific use mode can be at least one of the camping mode, the standing mode, and the flat panel mode of the notebook computer.

For instance, four compensation-matching circuits can be set in a form of one-to-one correspondence for the deviation use mode, the exhibition use mode, the flat panel mode, and the certification test mode of the notebook computer mentioned above. Naturally, the number of the compensation matching circuits can be increased or decreased according to the use mode and the environmental condition of the wireless communication device, compensating the frequency shifting in different cases. For example, for the notebook computer, in which the angle $\alpha$ between the first body and the second body only varies in the range of 0 to 180 degrees, the compensation matching circuit can only include a compensation matching circuit corresponding to the deviation use mode and a compensation matching circuit corresponding to the certification test mode, excluding a compensation matching circuit corresponding to the exhibition use mode and that corresponding to the flat panel mode.

It should be noted that, the notebook computer is only taken as an example for illustration in above descriptions, and it is not intended to make any limitation on the present invention. For other type of the wireless communication device, there can be other frequency shifted operating modes, and thus there are varieties of compensation matching circuits corresponding to say other frequency shifted operating modes.

At step S120, the use mode, in which the wireless communication device operates, is detected to obtain a detecting result. Different means can be utilized for detection, according to the characteristics of different use modes or environmental conditions of different wireless communication device. For example, when the wireless communication device is a notebook computer, the normal operating mode, the deviation use mode, the standing mode, the camping mode, and the flat panel mode can be determined. The notebook computer operates therein by detecting the value of the angle $\alpha$ between the first body and the second body of the notebook computer, and it can be determined whether the notebook computer operates in the certification test mode by detecting the sensing capacitor formed between the human body and the antenna of the notebook computer.

When the detecting result indicates that, the wireless communication device is in the normal operating mode, none of the compensation matching circuits function and the traditional antenna circuit for the normal operating mode functions. For example, when the notebook computer operates in the use mode, in which the angle $\alpha$ approximates to 110 degrees, the traditional antenna circuit is employed for transmission and reception of signals, and the individual compensation matching circuits corresponding to the deviation use mode, the exhibition use mode, the flat panel mode, and the certification test mode does not function.

At step S130, when the detecting result indicates that the wireless communication device is in the frequency shifted operating mode, switching to the compensation matching circuit corresponding to the detected frequency shifted operating mode, so as to compensate the frequency shifting of the antenna.

Taking the notebook computer as an example for illustration, when the detecting result indicates that the notebook computer is in the deviation use mode, the compensation matching circuit corresponding to the deviation use mode is utilized. When the detecting result indicates that the notebook computer is in the exhibition use mode, the compensation matching circuit corresponding to the exhibition use mode is utilized. When the detecting result indicates that the notebook computer is in the flat panel mode, the compensation matching circuit corresponding to the flat panel mode is utilized. When the detecting result indicates that the notebook computer is in the certification test mode, the compensation matching circuit corresponding to the certification test mode is utilized. Thus, the shifting of the working band of the antenna can be compensated differently for the different use modes or environmental conditions of the notebook computer.

In the case that the compensation matching circuit includes a double-throw switch, the step of switching to the compensation matching circuit corresponding to the detecting result includes changing the operating state of the double-throw switch. With regard to the particular operating method of the compensation matching circuits of the antenna, detailed descriptions will be given with respect to FIG. 2 and FIG. 3.

In the method for compensating the frequency shifting of the antenna, according to the embodiment of the present invention as described above, by detecting the use mode of the wireless communication device and using the compensation matching circuit in the antenna corresponding to the frequency shifted operating mode to communicate, the difficulty in the bandwidth design of the antenna of the wireless communication device is reduced, and the effect of the variation of the use mode or environmental condition on the performance of the antenna is compensated adaptively.

Hereinafter, the implementation and the operation of the method for compensating the frequency shifting of the antenna are illustrated with reference to the deviation use mode and the certification test mode of the notebook computer, respectively.

Figure 2:
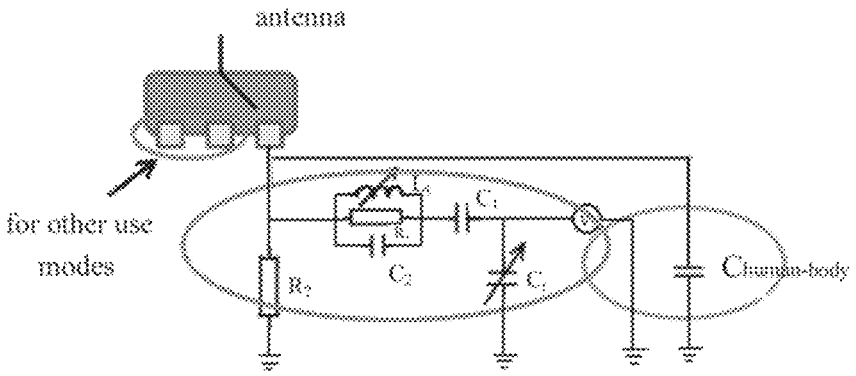
FIG. 2 schematically illustrates an equivalent circuit diagram of an antenna of a notebook computer in a certification test mode.

FIG. 2 schematically illustrates an equivalent circuit diagram of the antenna of the notebook computer in the certification test mode. FIG. 2 illustrates that the antenna has three use modes, e.g., the normal use mode, the certification test mode, and the deviation use mode, which are frequency shifted operating modes. The use mode of the antenna can be switched by a RF (Radio Frequency) switch. When the RF switch operates, it switches to the compensation matching circuit corresponding to the certification test mode or the deviation use mode. FIG. 2 illustrates an equivalent circuit diagram of the antenna in the certification test mode, wherein the equivalent circuit includes a capacitive element and/or an inductive element and comprises a sensing capacitor $C_{human-body}$ formed between the human body and the antenna to determine the working band of the antenna. For other use modes, e.g., the normal use mode or the deviation use mode, there are other forms of equivalent circuits.

In FIG. 2, an adaptive matching effect for compensation is achieved by changing a matching network in the antenna. When the notebook computer operates in the use mode, in which the angle $\alpha$ is around 110 degrees (the normal use mode), the RF switch is controlled so that the matching circuit corresponding to the normal use mode operates. At this time, the antenna has an optimal performance. In the certification test mode, in which the human body is close to the antenna, the sensing capacitor $C_{human-body}$ is formed between the human body and the antenna. It can be detected that the notebook computer is in the certification test mode through the sensing capacitor $C_{human-body}$, and then, it switches to the compensation matching circuit corresponding to the detected certification test mode for compensating the frequency shifting of the antenna. In the certification test mode, both the compensation matching circuit, corresponding to the certification test mode and the sensing capacitor $C_{human-body}$ form a matching circuit of the antenna. The matching circuit brings the antenna into the state of partial mismatching, so that a part of energy returns to the antenna, thus reducing the radiation power on the human body and meeting the SAR testing standard. Therefore, in the case that the detecting result indicates that the frequency shifted operating mode in the certification test mode, the sensing capacitor $C_{human\text{-}body}$ is formed between the human body and the antenna. The compensation matching circuit corresponding to the certification test mode is switched and functions, and cooperates with the sensing capacitor $C_{human\text{-}body}$ to compensate the frequency shifting in the certification test mode. Thus, the requirement of a high radiation efficient and that of a low SAR are satisfied at the same time.

Figure 3:
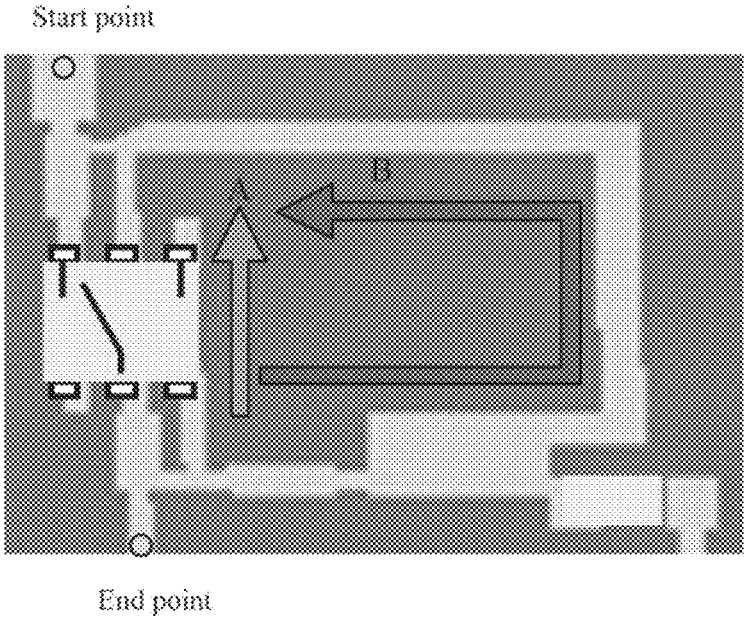
FIG. 3 schematically illustrates operating states of the antenna of the notebook computer in different use modes.

FIG. 3 schematically illustrates operating states of the antenna of the notebook computer in different use modes.

In FIG. 3, an adaptive matching effect for compensation of the antenna is achieved by changing a current path in the antenna, wherein the hollow circle at the bottom shows a start point of the current path, and the hollow circle at the top shows an end of the current path. The use mode in which the notebook computer operates is detected by determining the angle $\alpha$ between the first body and the second body of the notebook computer, wherein when the angle $\alpha$ is around 110 degrees, and the notebook computer is in the normal use mode. When the angle $\alpha$ is within the range of 0 to 180 degrees, but deviates from 110 degrees (e.g., is around 85 degrees or around 125 degrees), the notebook computer is in the deviation use mode. When the notebook computer is in the normal use mode, the double-throw switch in FIG. 3 is connected to the left, so that the current signal flows from the start point to the end point along the path as shown by an arrow A, thus achieving an optimal radiation performance of the antenna. When the notebook computer is in the deviation use mode (where the angle $\alpha$ is about 85 degrees or about 125 degrees), the double-throw switch in FIG. 3 is connected to the right, so that the current signal flows from the start point to the end point along the path as shown by an arrow B, thus compensating the frequency shifting due to the variation of the use mode by the changing of the current path. In FIG. 3, the double-throw switch serves as a compensation matching circuit, and the compensation matching circuit, corresponding to the detecting result, is switched by changing the operating state of the double-throw switch. It should be noted that the double-throw switch in FIG. 3 is only shown schematically, and it is possible to adopt other type of switch, e.g. a single-pole multi-throw switch, and thus, the frequency shifting can be compensated when there are more than one frequency shifted operating modes.

Figure 4:
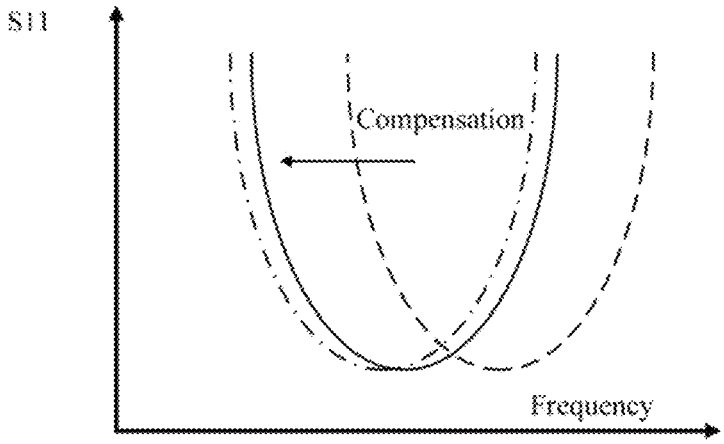
FIG. 4 schematically illustrates an effect of the frequency shifting compensation applied to the frequency shifted operating mode of the notebook computer.

FIG. 4 schematically illustrates the effect of the frequency shifting compensation on the frequency shifted operating mode of the notebook computer. In FIG. 4, a horizontal axis shows the working band of the antenna, and a vertical axis shows the parameter S11 indicating the ratio of power of an incident wave to that of a reflected wave (return loss). In FIG. 4, the dash dot line on the left shows distributed values of the parameter S11 over the frequency when the notebook computer is in the normal use mode, that is, the distributed values of the parameter S11 when the antenna has an optimal radiation performance. The dot line on the right shows the distributed values of the parameter S11 when the notebook computer is in the deviation use mode, but the compensation matching circuit is not employed. The solid line in the middle shows the distributed values of the parameter S11 when the notebook computer is in the deviation use mode, and the compensation matching circuit is employed. It can be seen that in FIG. 4, when the notebook computer is in the deviation use mode, compared to the distributed values of the parameter S11 in the case where the compensation matching circuit is not employed, the distributed values of the parameter S11, in the case where the compensation matching circuit is employed, is close to the distributed values of the parameter S11 in the normal use mode. Thus, the effect on the antenna performance due to the variation of the use mode of the notebook computer is compensated.

Figure 5:
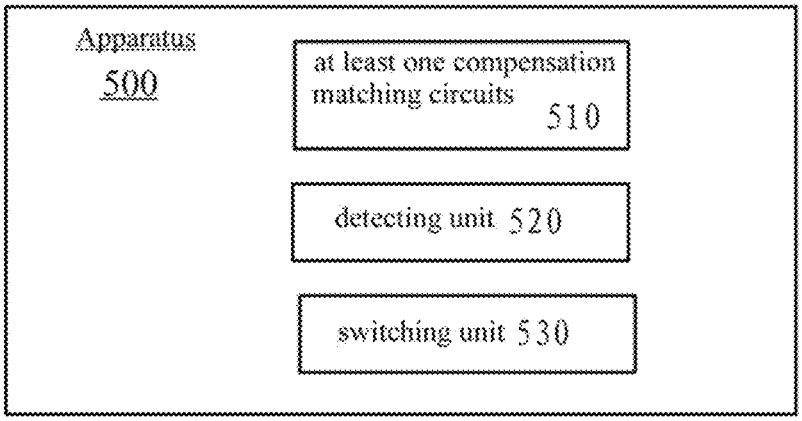
FIG. 5 illustrates a block diagram of an apparatus for compensating the frequency shifting of the antenna according to an exemplified embodiment of the present invention.

FIG. 5 illustrates a block diagram of an apparatus 500 for compensating the frequency shifting of an antenna, according to an exemplified embodiment of the present invention. The apparatus 500 for compensating the frequency shifting of an antenna can be used in any of the wireless communication devices having an antenna. The wireless communication device has at least one frequency shifted operating mode, in which a frequency shifting exists due to a variation of the use mode of the wireless communication device or the environmental condition.

It is possible to define a plurality of frequency shifted operating modes for the different use modes or the environmental conditions, in which the wireless communication device operates. For instance, the frequency shifted operating modes can comprise the certification test mode, in which a human body is close to the antenna and can further comprise some specific use modes of the wireless communication device.

Taking a notebook computer as an example for illustration, as mentioned above, the notebook computer can have the use mode, in which the angle $\alpha$ is around 110 degrees (i.e., the normal use mode), the deviation use mode, in which the angle $\alpha$ is around 85 degrees or 125 degrees, the flat panel mode, in which the angle $\alpha$ is around 360 degrees, the camping mode in which the angle $\alpha$ is in the range of 180 to 360 degrees, and the angle is on upside, the standing mode, in which the angle $\alpha$ is in the range of 180 to 360 degrees, and the keyboard faces downwards, and the certification test mode, in which a human body is close to the notebook. At this time, specific use modes of the notebook computer comprise at least one of the deviation use mode, the camping mode, the standing mode, and the flat panel mode.

In addition, for other type of the wireless communication device, one or more frequency shifted operating modes can be defined for the wireless communication device based on the cases in which the antenna of the wireless communication device shifts over the frequency in different use modes or environmental conditions.

The apparatus 500 for compensating the frequency shifting of an antenna can comprises at least one compensation matching circuit 510 for compensating the frequency shifting under the at least one frequency shifted operating mode; a detecting unit 520 for detecting the use mode, in which the wireless communication device operates to obtain a detecting result; and a switching unit 530 for switching to a compensation matching circuit corresponding to the detected frequency shifted operating mode to compensate the frequency shifting of the antenna when the detecting result indicates that the wireless communication device is in the frequency shifted operating mode.

One or more compensation matching circuits 510 can be set for the different frequency shifted operating modes of the wireless communication device. For example, it can be set as shown in FIG. 2 a compensation matching circuit corresponding to the certification test mode, which is in frequency shifted operating mode, wherein the compensation matching circuit comprises a capacitive element, an inductive element, and particularly comprises the sensing capacitor $C_{human\text{-}body}$ formed between the human body and the antenna. Additionally, as shown in FIG. 3, the compensation matching circuit can include a double-throw switch, so that the operating state of the double-throw switch can be changed from different current paths in different use modes, thus compensating the frequency shifting in different frequency shifted operating modes. It should be noted that for different wireless communication devices or for different frequency shifted operating modes of the same wireless communication device, other forms of the compensation matching circuits can be adopted in practice.

The detecting unit 520 can detect the use mode, in which the wireless communication device operates to obtain a detecting result. Different means can be utilized for detection, according to the characteristics of different use modes of different wireless communication devices. For example, when the wireless communication device is a notebook computer, the detecting unit 520 can determine, among the normal operating mode, the deviation use mode, the standing mode, the camping mode, and the flat panel mode, which one the notebook computer operate therein by detecting the value of the angle $\alpha$ between the first body and the second body of the notebook computer and can determine that the notebook computer operates in the certification test mode by detecting the sensing capacitor $C_{human\text{-}body}$ formed between the human body and the antenna of the notebook computer.

When the detecting result from the detecting unit 520 indicates that, the wireless communication device operates in the normal operating mode, none of the compensation matching circuits corresponding to the individual frequency shifted operation modes function, and the traditional antenna circuit for the normal operating mode functions. For example, when the notebook computer operates in the use mode in which the angle $\alpha$ is around 110 degrees, the traditional antenna circuit is employed for the transmission and reception of signals, and none of the individual compensation matching circuits corresponding to the deviation use mode, the exhibition use mode, the flat panel mode, and the certification test mode one-to-one function.

When the detecting result from the detecting unit 520 indicates that the wireless communication device is in the frequency shifted operating mode, the switching unit 530 can switch to the compensation matching circuit corresponding to the detected frequency shifted operating mode to compensate the frequency shifting of the antenna.

As an example, in the case where the detecting result indicates that the frequency shifted operating mode is the certification test mode, as shown in FIG. 2, the switching unit 530 can switch to the compensation matching circuit corresponding to the certification test mode, and the compensation matching circuit corresponding to the certification test mode cooperates with the sensing capacitor formed between the human body and the antenna to partially compensate the frequency shifting in the certification test mode. Thus, the requirement of a high radiation and that of a low SAR are satisfied at the same time. In the case where the detecting result indicates that the frequency shifted operating mode is the deviation use mode (for example, the angle $\alpha$ is around 85 degrees or around 125 degrees), as shown in FIG. 3, the operating state of the double-throw switch that is a part of the compensation matching circuit is changed, which switches to the right so that the path of the current signal flows through changes to the path, as shown by the arrow B, to compensate the frequency shifting of the antenna in the deviation use mode.

In the apparatus for compensating the frequency shifting of the antenna, according to the embodiment of the present invention as described above, by detecting the use mode of the wireless communication device and using the compensation matching circuit in the antenna corresponding to the frequency shifted operating mode to communicate, the difficulty in the bandwidth design of the antenna in the wireless communication device is reduced, and the effect of the variation of the use mode or environmental condition on the performance of the antenna is compensated adaptively.

For the purpose of convenience and simplicity of the description, it is clear that those skilled in the art can easily understand the particular processes of the apparatus and units therein as described above with reference to the corresponding processes in the embodiments of the method described hereinbefore, and the detailed thereof is omitted.

Those skilled in the art can appreciate that the units and the steps of the algorithm in individual examples described in combination with the embodiments disclosed herein can be implemented in electronic hardware or the combination of computer software and electronic hardware. Whether the functions are carried out in the form of hardware or in the form of software, it depends on the specific applications of the technical solution and constrains on the design thereof. Those skilled in the art can use different methods to implement the functions as described for each specific application, and such an implementation should not be considered as going beyond the scope of the present invention.

In the embodiments provided in the application, it should be understood that the apparatus and the method as disclosed could be implemented in other manners. For example, the embodiments of the apparatus are only for illustration, e.g., the division of the unit only shows a function division in logic, but in an actual realization, there are other forms of divisions. For example, a plurality of units or components can be combined or can be integrated into another system, or some features can be ignored.

If the functions are implemented in the function units in software, which is on sale or used as separate products, they can be stored in a computer readable storage medium. Based on the understanding, the solution of the present invention, in essence or the part of the present invention contributing to the prior art or a part of the technical solution can be embodied in software products. The computer software products are stored in a storage medium and comprise several instructions to cause a computing device (can be a personal computer, a server, a network device, or the like) to carry out the entire or partial steps of the methods of the individual embodiments of the present invention.

The above descriptions only illustrate the specific embodiments of the present invention, and the protection scope of the present invention is not limited to these embodiments. Given the teaching as disclosed herein, variations or substitutions, which can easily occur to any skilled pertaining to the art, should be covered by the protection scope of the present invention. Thus, the protection scope of the present invention is defined by the claims.

What is claimed is:

1. A method for compensating frequency shifting of an antenna, applicable to a notebook computer with the antenna, the notebook computer having two or more frequency shifted operating modes in which there exists frequency shifting due to a variation of a use mode of the notebook computer or that of an environmental condition, the notebook computer including a first body and a second body having a keyboard which form an included angle $\alpha$, the method comprising:

setting in the antenna two or more compensation matching circuits corresponding to the two or more frequency shifted operating modes comprising a specific use mode of the notebook computer, the specific use mode being at least one of a camping mode in which the included angle α is in a range of 180-360 degrees and is upside, a standing mode in which the included angle α is in the range of 180-360 degrees and the keyboard faces downwards, and a flat panel mode in which the included angle α is about 360 degrees;

detecting the use mode in which the notebook computer operates according to characteristics of the use mode or the environmental condition of the wireless communication device to obtain a detecting result; and when the detecting result indicates that the notebook computer is in the specific use mode, switching to a compensation matching circuit to compensate the frequency shifting of the antenna based on the detected specific use mode.

2. The method as recited in claim 1, wherein the frequency shifted operating modes further comprise a certification test mode in which a human body is determined to be within a predetermined range of the antenna.

3. The method as recited in claim 2, wherein, in a case where the detecting result indicates that the frequency shifted operating mode is the certification test mode, a sensing capacitor is formed between the human body and the antenna, switching to the compensation matching circuit corresponding to the certification test mode, and the compensation matching circuit corresponding to the certification test mode cooperates with the sensing capacitor to partially compensate the frequency shifting in the certification test mode.

4. The method as recited in claim 1, wherein:

the compensation matching circuit includes a double-throw switch, and the step of switching to the compensation matching circuit corresponding to the detecting result includes changing an operating state of the double-throw switch.

5. An apparatus for compensating frequency shifting of an antenna, being used in a notebook computer having the antenna, the notebook computer having two or more frequency shifted operating modes in which there exists a frequency shifting due to a variation of a use mode of the notebook computer or an environmental condition, the notebook computer including a first body and second body having a keyboard which form an included angle α, wherein the apparatus comprises:

two or more compensation matching circuits, for compensating the frequency shifting in correspondence with the two or more frequency shifted operating modes comprising a specific use mode of the notebook computer, the specific use mode being at least one of a camping mode in which the included angle α is in a range of 180-360 degrees and is upside, a standing mode in which the included angle α is in the range of 180-360 degrees and the keyboard faces downwards, and a flat panel mode in which the included angle α is about 360 degrees;

a detecting unit that detects the use mode in which the notebook computer operates to obtain a detecting result according to characteristics of the use mode or the environmental condition of the notebook computer; and a switching unit that switches to a compensation matching circuit so as to compensate the frequency shifting of the antenna based on the detected specific use mode when the detecting result indicates that the notebook computer is in the specific use mode.

6. The apparatus as recited in claim 5, wherein the frequency shifted operating modes further comprise a certification test mode in which a human body is determined to be within a predetermined range of the antenna.

7. The apparatus as recited in claim 6, wherein, in a case where the detecting result indicates that the frequency shifted operating mode is the certification test mode, a sensing capacitor is formed between the human body and the antenna, and the switching unit switches to the compensation matching circuit corresponding to the certification test mode, the compensation matching circuit corresponding to the certification test mode cooperates with the sensing capacitor to partially compensate the frequency shifting in the certification test mode.

8. The apparatus as recited in claim 5, wherein:

the compensation matching circuit includes a double-throw switch, and the switching unit switches to the compensation matching circuit corresponding to the detecting result by changing the operating state of the double-throw switch.

* * * * *